US009266252B1

(12) United States Patent
Panos

(10) Patent No.: US 9,266,252 B1
(45) Date of Patent: Feb. 23, 2016

(54) LOG HOLDING PLATE

(76) Inventor: Gary Panos, Waucoma, IA (US)

( * ) Notice: Subject to any disclaimer, the term of this patent is extended or adjusted under 35 U.S.C. 154(b) by 1010 days.

(21) Appl. No.: 13/424,971

(22) Filed: Mar. 20, 2012

(51) Int. Cl.
*B27L 7/06* (2006.01)

(52) U.S. Cl.
CPC ..... *B27L 7/06* (2013.01)

(58) Field of Classification Search
CPC ..... B27L 7/00; B27L 7/06; B27L 7/08
See application file for complete search history.

(56) References Cited

U.S. PATENT DOCUMENTS 4,061,168 A * 12/1977 Fariss, Jr. ..... 144/193.1
4,544,008 A 10/1985 Reini
4,700,759 A * 10/1987 Duerr ..... 144/195.1
4,793,391 A * 12/1988 Mauer ..... 144/195.1
4,842,030 A 6/1989 Meyer
5,022,445 A 6/1991 Holestine
5,526,855 A 6/1996 Graham
7,334,615 B2 * 2/2008 Paradise ..... 144/193.2
2005/0167000 A1 * 8/2005 Dick ..... 144/253.1

FOREIGN PATENT DOCUMENTS

FR 2597779 A * 10/1987

* cited by examiner

*Primary Examiner* — Matthew G Katcoff
(74) *Attorney, Agent, or Firm* — Crossley Patent Law

(57) ABSTRACT

A log holding plate having a base plate and a hook on a top side thereof that attaches the log holding plate to a rearward holder member of a hydraulically controlled log splitting device and also having with a bottom support rib member attached to a bottom end of the base plate that braces a log against a forward wedge of the log splitting device to position and secure the log in place for splitting.

7 Claims, 3 Drawing Sheets

LOG HOLDING PLATE

BACKGROUND OF THE INVENTION

Various types of attachments for a log splitter are known in the prior art. However, what is needed is a log holding plate having a base plate and a hook on a top side thereof that attaches the log holding plate to a rearward holder member of a hydraulically controlled log splitting device and also having with a bottom support rib member attached to a bottom end of the base plate that braces a log against a forward wedge of the log splitting device to secure the log in place for splitting.

FIELD OF THE INVENTION

The present invention relates to log splitter attachments, and more particularly, to a log holding plate that braces a log between a base plate thereof and a forward wedge of a log splitting device.

SUMMARY OF THE INVENTION

The general purpose of the present log holding plate, described subsequently in greater detail, is to provide a log holding plate which has many novel features that result in a log holding plate which is not anticipated, rendered obvious, suggested, or even implied by prior art, either alone or in combination thereof.

To accomplish this, the instant log holding plate is utilized in combination with a hydraulically controlled log splitting device attached to a skid loader. The log holding plate includes a parallelepiped plate base. The plate base includes a front side, a rear side opposite the front side, a top side, a bottom side opposite the top side, a first side, and a second side.

A notch is centrally disposed in the plate base top side. An L-shaped hook is disposed on the top side proximal to each of the first side and the second side. Each hook includes an upper side having a forward end attached to the plate base top side. The upper side is disposed in a position perpendicular to the plate base front side. Each hook also includes a rearward side having an upper end attached to the upper side. The rearward side is disposed in a position parallel and proximal to the plate base rear side. A parallelepiped support rib member having an upper wall continuously disposed along the bottom side of the plate base is attached at a forward angle therefrom on an opposite side of the plate base from the hook. The forward angle is greater than 90 degrees and less than 180 degrees and can be approximately 135 degrees.

The hook is configured to engage a top wall of a rearward holder member of the log splitting device. The notch is configured to receive a front beam of the log splitting device therethrough. The rear side of the plate base is disposed in a position parallel to a forward side of the rearward holder member of the log splitting device upon the engagement of the hook to the top wall of the rearward holder member. The plate base front side and the support rib member are configured to brace a log against a forward wedge of the log splitting device.

Hydraulic control lines of the skid loader operationally engage the rearward holder member having the hook of the present log holding plate attached thereto. Upon the active operational engagement of the hydraulic control lines to the rearward holder member, the log holding plate braces the log against the forward wedge to secure the log in position for splitting.

Thus has been broadly outlined the more important features of the present log holding plate so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
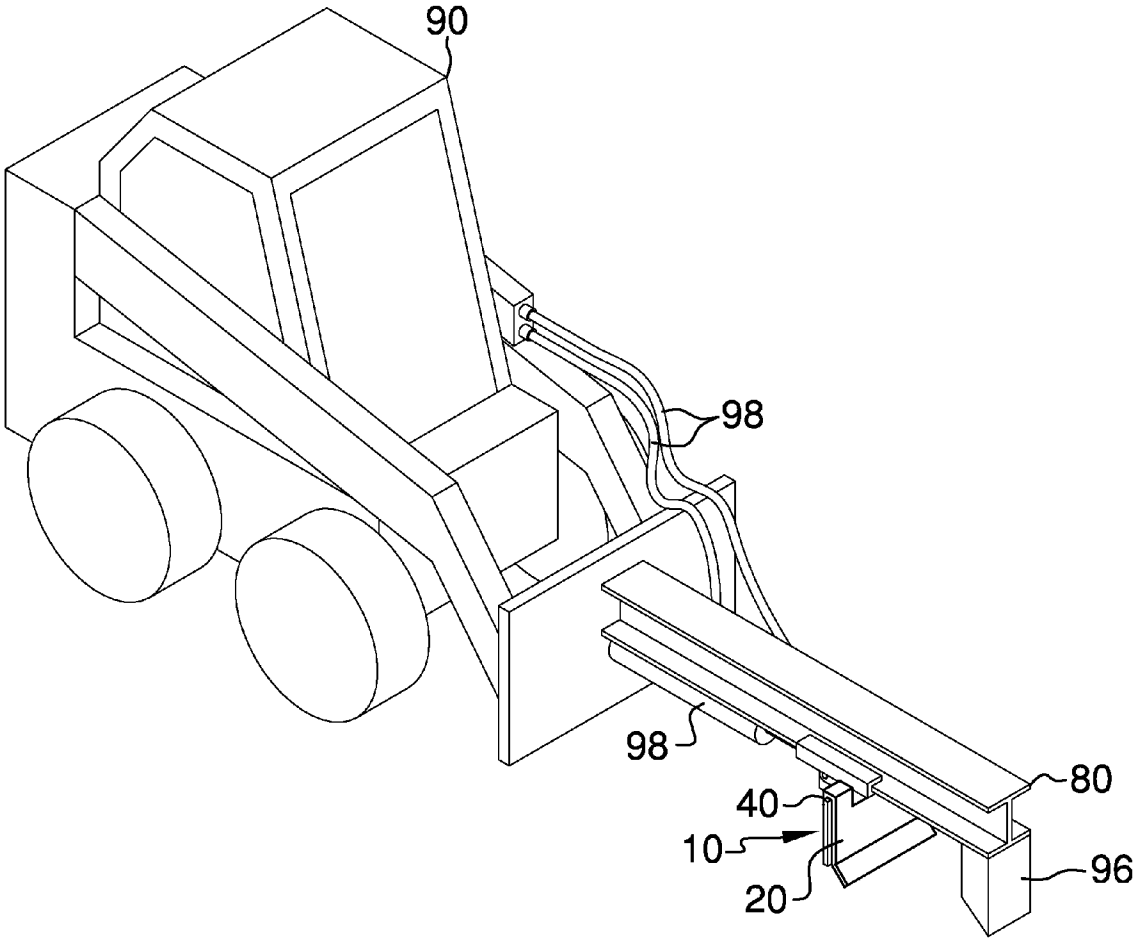
FIG. 1 is an in-use perspective view.
Figure 2:
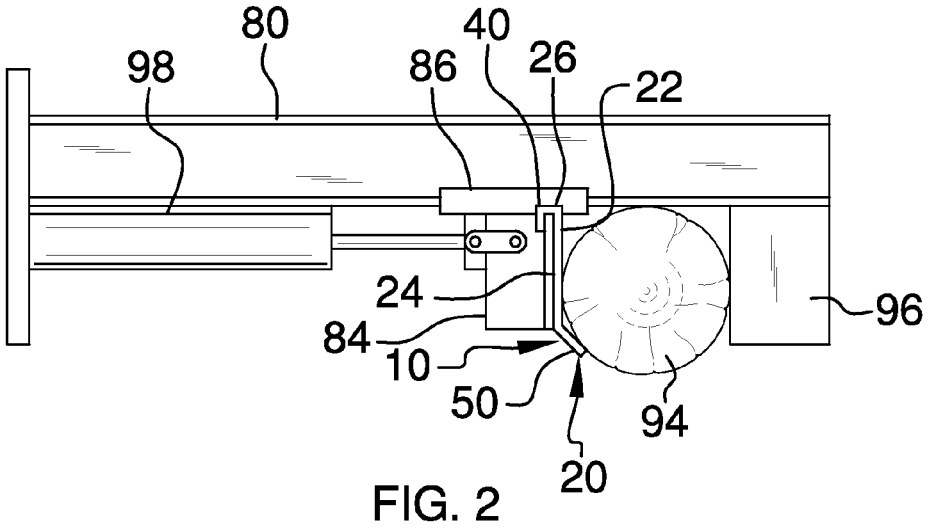
FIG. 2 is a side elevation view.
Figure 3:
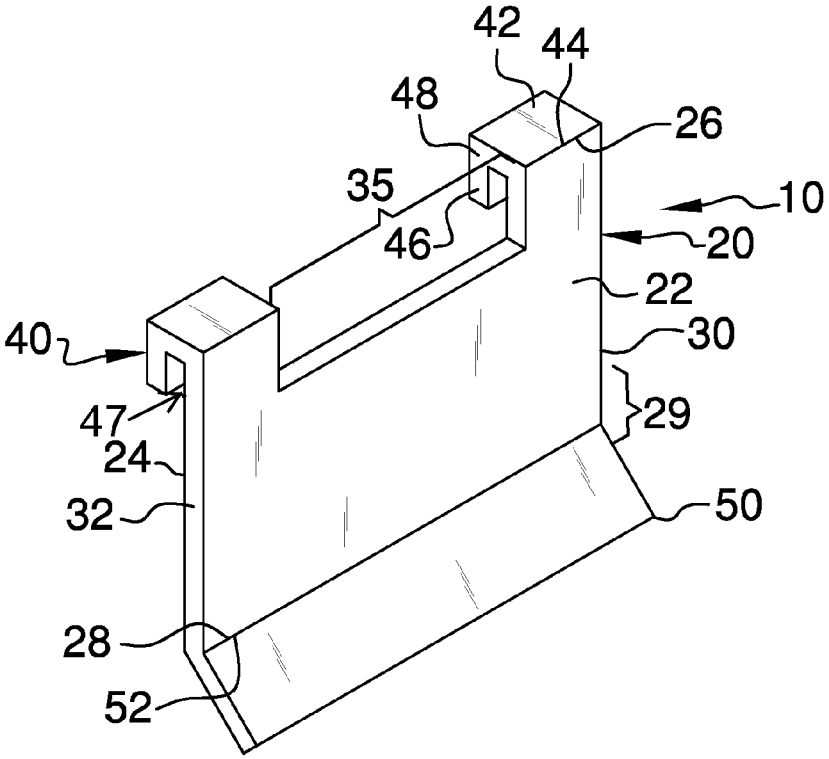
FIG. 3 is a perspective view.
Figure 4:
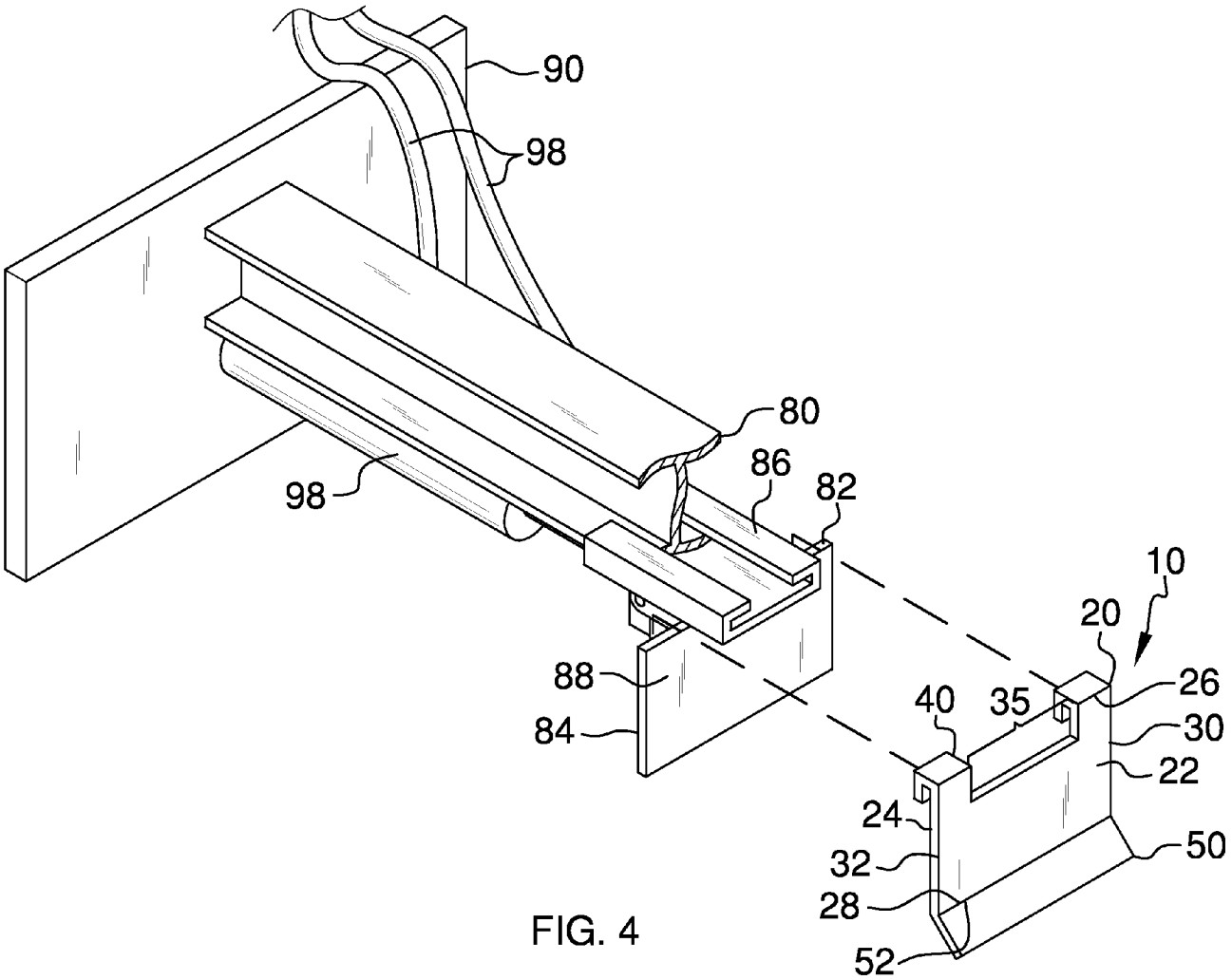
FIG. 4 is an exploded view showing the attachment of the device to a log splitter.

With reference now to the drawings, and in particular FIGS. 1 through 4 thereof, example of the instant log holding plate employing the principles and concepts of the present log holding plate and generally designated by the reference number 10 will be described.

Referring to FIGS. 1 through 4 a preferred embodiment of the present log holding plate 10 is illustrated. The instant log holding plate 10 is utilized in combination with a hydraulically controlled log splitting device 80 attached to a skid loader 90 to hold a log 94 in place for splitting. The log holding plate 10 includes a parallelepiped plate base 20. The plate base 20 includes a front side 22, a rear side 24 opposite the front side 22, a top side 26, a bottom side 28 opposite the top side 26, a first side 30, and a second side 32.

A notch 35 is centrally disposed in the plate base top side. A pair of hooks 40 is disposed on the rear side 26 proximal the top side 26. Each hook is disposed on one of the first side 30 and the second side 32. The notch 35 is centrally disposed between the hooks 40. Each hook 40 includes an upper side 42 having a forward end 44 attached to the plate base 20 top side 26. The upper side 42 is disposed in a position perpendicular to the plate base 29 front side 22. Each hook 40 also includes a parallelepiped rearward side 46 having an upper end 48 attached to the upper side 42. The rearward side 46 is disposed in a position parallel and proximal to the plate base 20 rear side 24 and directed downwardly toward the bottom side 28. Each hook 40 also has a gap 47 between the rearward side 46 and the plate base 20 rear side 24. The rearward side 46 has a length shorter than the plate base 20 rear side 24. The gap 47 has a width configured to accommodate a width of a top wall 82 of a rearward holder member 84 of a log splitting device 80. A parallelepiped support rib member 50 having an upper wall 52 continuously disposed along the bottom side 28 of the plate base 20 is attached at a forward angle 29 relative the front side on an opposite side of the plate base 20 from the hook 40. The support rib member 50 adds stability to and increases the durability of the plate base 20 and assists in placing and securing the log 94 in position during the log splitting process. The forward angle 29 is greater than 90 degrees and less than 180 degrees and can be approximately 135 degrees.

The hook 40 is configured to engage a top wall 82 of a rearward holder member 84 of the log splitting device 80. The notch 35 is configured to receive a front beam 86 of the log splitting device 80 therethrough. The rear side 24 of the plate base 20 is disposed in a position parallel to a forward side 88 of the rearward holder member 84 of the log splitting device 80 upon the engagement of the hook 40 to the top wall 82 of the rearward holder member 84. The plate base 20 front side 22 and the support rib member 50 are configured to brace a log 94 against a forward wedge 96 of the log splitting device 80.

Hydraulic control lines 98 of the skid loader 90 operationally engage the rearward holder member 84 having the hook 40 of the present log holding plate 20 attached thereto. Upon the active operational engagement of the hydraulic control lines to the rearward holder member 84, the log holding plate 20 braces the log 94 against the forward wedge 96.

What is claimed is:

1. A log holding plate in combination with a log splitting device attached to a skid loader, the log holding plate comprising:

a parallelepiped plate base comprising:

a front side;

a rear side opposite the front side;

a top side;

a bottom side opposite the top side;

a first side;

a second side;

a notch centrally disposed in the plate base top side; and a pair of hooks disposed on the plate base rear side proximal to the top side, each hook being disposed on one of the first side and the second side, the notch being centrally disposed between the hooks, each hook having an inverted L-shaped cross-section, a parallelepiped rearward side disposed in a position parallel to the plate base rear side and directed downwardly toward the bottom side, and a gap between the rearward side and the plate base rear side, the rearward side having a length shorter than the plate base rear side, the gap having a width configured to accommodate a width of a top wall of a rearward holder member of the log splitting device, each hook configured to engage the top wall of the rearward holder of the log splitting device;

wherein the plate base is configured to brace a log between the plate base front side and a forward wedge of the log splitting device attached to a skid loader.

2. The log holding plate of claim 1 further comprising a parallelepiped support rib member having an upper wall continuously attached along the bottom side of the plate base, the support rib member disposed at a forward angle relative the front side on an opposite side of the plate base from the hook.

3. The log holding plate of claim 2 further comprising:

wherein the rear side of the plate base is configured to be disposed in a position parallel to a forward side of the rearward holder member of the log splitting device upon the engagement of the hook to the top wall of the rearward holder member; and wherein the plate base front side and the support rib member are configured to brace a log against a forward wedge of a log splitting device.

4. A log holding plate in combination with a log splitting device attached to a skid loader, the log holding plate comprising:

a parallelepiped plate base comprising:

a front side;

a rear side opposite the front side;

a top side;

a bottom side opposite the top side;

a first side;

a second side;

a notch centrally disposed in the plate base top side;

a pair of hook disposed on the rear side proximal the top side, each hook being disposed on one of the first side and the second side, the notch being centrally disposed between the hooks, each hook having an inverted L-shaped cross-section, each hook comprising:

an upper side having a forward end attached to the plate base top side, the upper side disposed in a position perpendicular to the plate base front side;

a parallelepiped rearward side having an upper end attached to the upper side, the rearward side disposed in a position parallel and proximal to the plate base rear side and further directed downwardly toward the bottom side;

a gap between the rearward side and the plate base rear side, the rearward side having a length shorter than the plate base rear side, the gap having a width configured to accommodate a width of a top wall of a rearward holder member of the log splitting device, each hook configured to engage the top wall of the rearward holder of the log splitting device;

a parallelepiped support rib member having an upper wall continuously attached along the bottom side of the plate base, the support rib member disposed at a forward angle relative the front side on an opposite side of the plate base from the hook;

wherein the plate base is configured to brace a log between the plate base front side and a forward wedge of the log splitting device attached to a skid loader.

5. The log holding plate of claim 4 wherein the forward angle is greater than 90 degrees and less than 180 degrees.

6. The log holding plate of claim 5 wherein the rear side of the plate base is disposed in a position parallel to a forward side of the rearward holder member of the log splitting device upon the engagement of the hook to the top wall of a rearward holder member of the log splitting device;

wherein the notch is configured to receive a front beam of a log splitting device therethrough;

wherein the plate base front side and the support rib member are configured to brace a log against a forward wedge of a log splitting device.

7. A log holding plate in combination with a log splitting device attached to a skid loader, the log holding plate comprising:

a parallelepiped plate base comprising:

a front side;

a rear side opposite the front side;

a top side;

a bottom side opposite the top side;

a first side;

a second side;

a notch centrally disposed in the plate base top side;

a pair of hook disposed on the rear side proximal the top side, each hook being disposed on one of the first side and the second side, the notch being centrally disposed between the hooks, each hook having an inverted L-shaped cross-section, each hook comprising:

an upper side having a forward end attached to the plate base top side, the upper side disposed in a position perpendicular to the plate base front side;

a parallelepiped rearward side having an upper end attached to the upper side, the rearward side disposed in a position parallel and proximal to the plate base rear side and further directed downwardly toward the bottom side;

a gap between the rearward side and the plate base rear side, the rearward side having a length shorter than the plate base rear side, the gap having a width configured to accommodate a width of a top wall of a rearward holder member of the log splitting device, each hook configured to engage the top wall of the rearward holder of the log splitting device;

a parallelepiped support rib member having an upper wall continuously attached along the bottom side of the plate base, the support rib member disposed at a forward angle relative the front side on an opposite side of the plate base from the hook, wherein the forward angle is approximately 135 degrees;

wherein the rear side of the plate base is configured to be disposed in a position parallel to a forward side of the rearward holder member of the log splitting device upon the engagement of the hook to the top wall of the rearward holder member;

wherein the notch is configured to receive a front beam of a log splitting device therethrough;

wherein the plate base is configured to brace a log between the plate base front side and a forward wedge of the log splitting device attached to a skid loader.

* * * * *